US005522445A

United States Patent [19]

Hoffman

[11] Patent Number: 5,522,445

[45] Date of Patent: Jun. 4, 1996

[54] ACCORDION FOLD PANEL GUIDE TRACK

[76] Inventor: Robert E. Hoffman, 5618 Riviera Dr., Coral Gables, Fla. 33146

[21] Appl. No.: 298,657

[22] Filed: Aug. 31, 1994

[51] Int. Cl.[6] ..... E05D 15/00; E06B 3/48; A47H 13/00

[52] U.S. Cl. ..... 160/183; 160/118; 160/206; 16/87.4 R; 16/94 D

[58] Field of Search ..... 160/113, 110, 160/183, 196.1, 199, 206; 16/87 R, 87.4 R, 94 D, 95 D, 96 D

[56] References Cited

U.S. PATENT DOCUMENTS

| | | | |
|---|---|---|---|
| 4,799,528 | 1/1989 | Benitez | 160/199 |
| 5,097,883 | 3/1992 | Robinson et al. | 160/199 X |
| 5,099,904 | 3/1992 | Susnar | 160/199 |
| 5,406,676 | 4/1995 | Williams | 16/87 R |

*Primary Examiner*—Kenneth J. Dorner
*Assistant Examiner*—Bruce A. Lev
*Attorney, Agent, or Firm*—Harness, Dickey & Pierce

[57] ABSTRACT

An accordion fold panel closure, formed of numerous, vertically extending, narrow, hingedly connected blades is suspended from an upper track and has its lower edge engaged within a lower guide track. An extruded channel is formed to function either as an upper or lower track. The channel includes a base, integral side walls, and opposing flanges which partially cover the mouth of the channel. One of the flanges is provided with a laterally opening groove. The lower edges of the panel, at the hinge points, are provided with guide pins that extend into the lower track. The guide pins have laterally extending washers which fit into the groove of one of the flanges and are overlapped by the opposite flange. The track also includes interior wheels receiving channels so that support members having a pair of wheels may be arranged within the upper track for suspending the panel therefrom. The lower pins and their washers may be moved laterally into and out of the groove but always overlapped by the opposite flange, to prevent the panel lower edge from being blown in one direction or sucked in the opposite direction by corresponding positive or negative high wind velocity forces such as that caused by a gale or a hurricane.

12 Claims, 2 Drawing Sheets

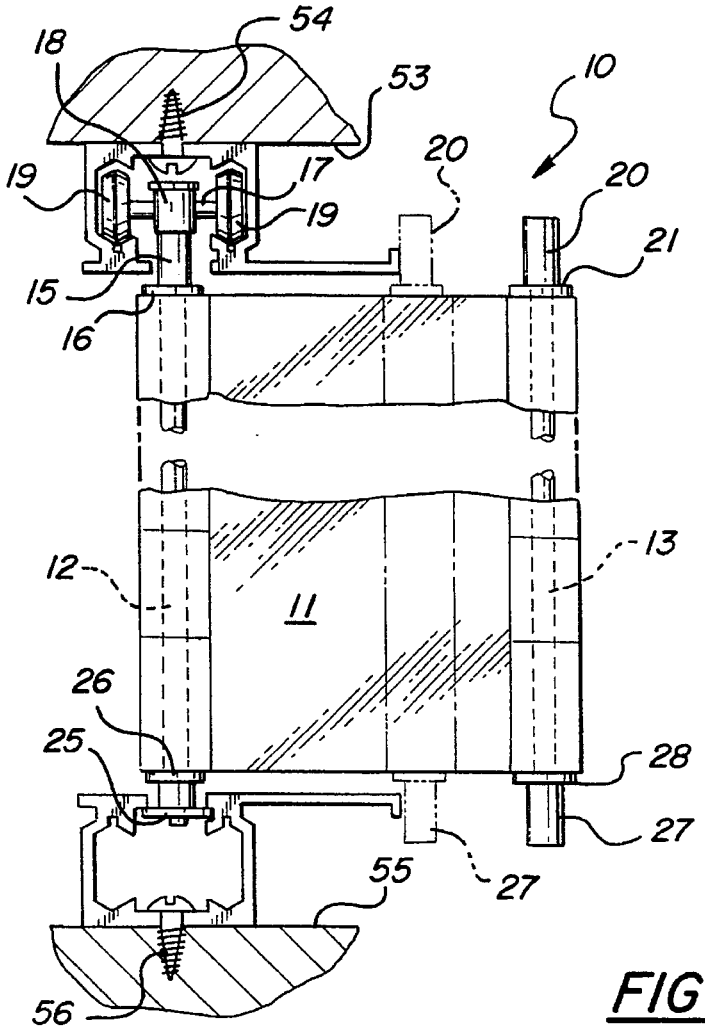
FIG-1
FIG-2
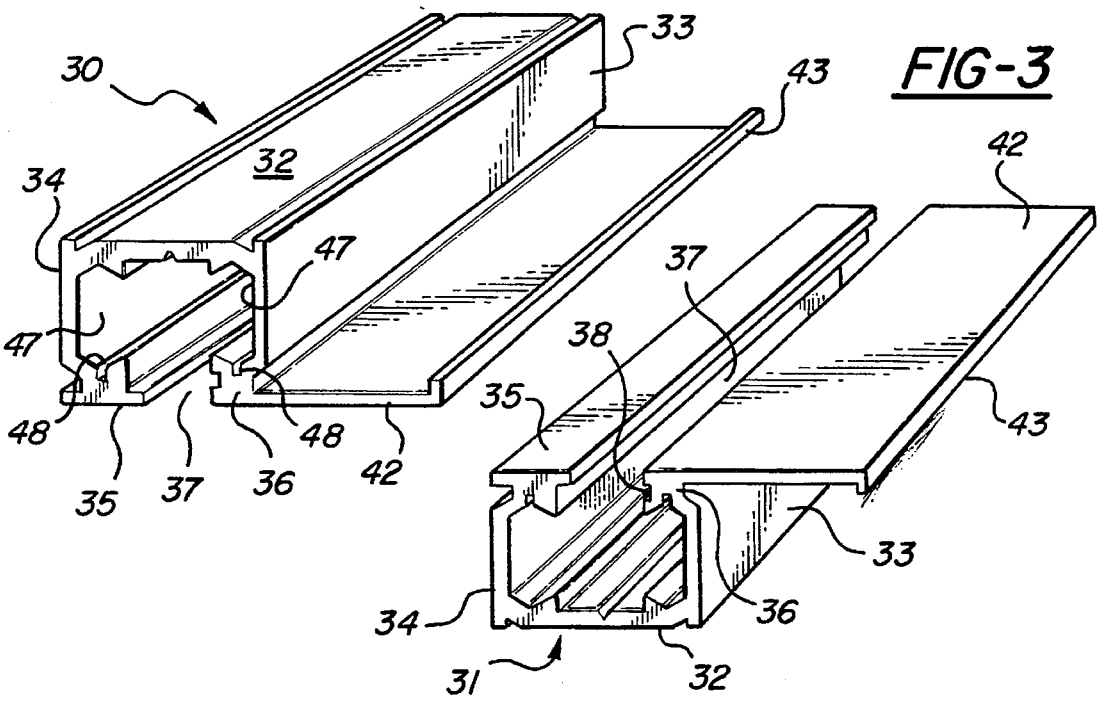
FIG-3

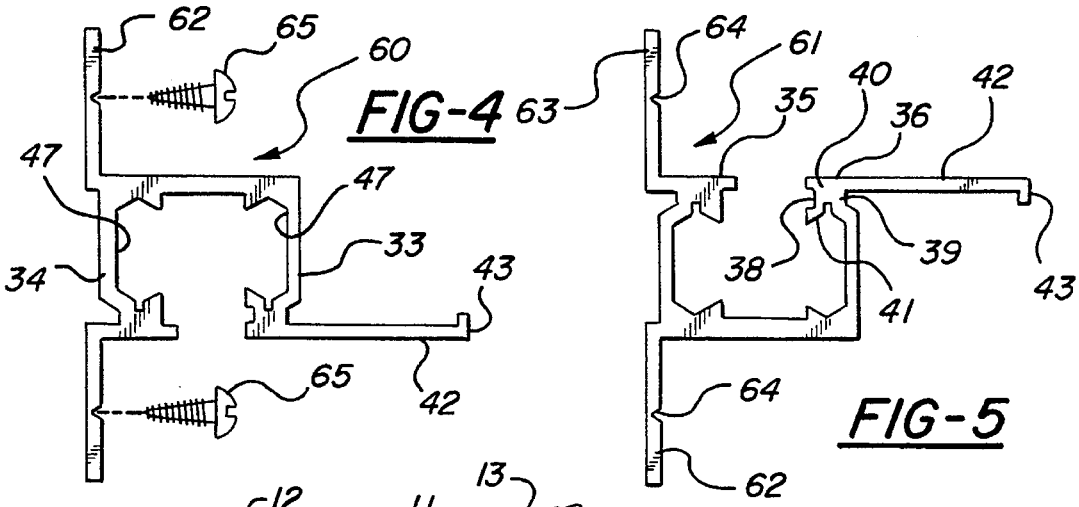
FIG-4
FIG-5
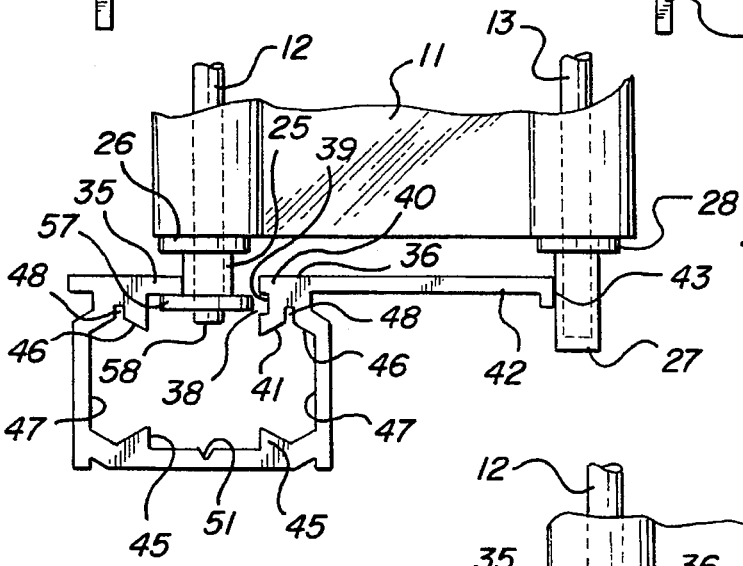
FIG-6
FIG-7
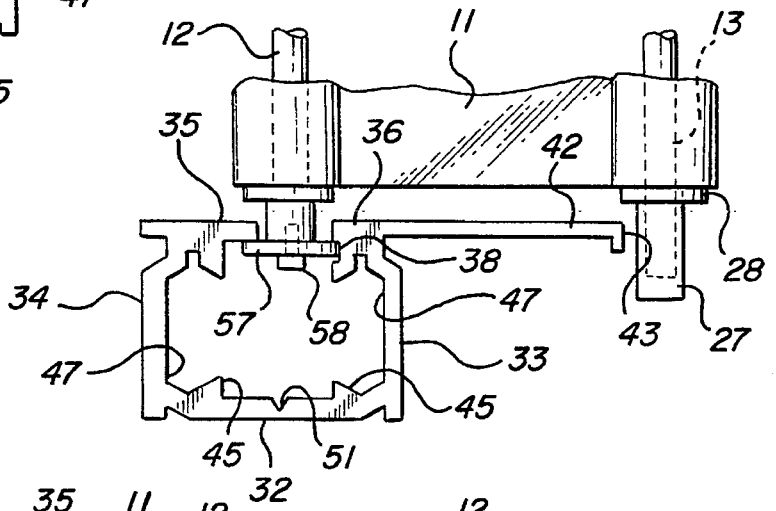
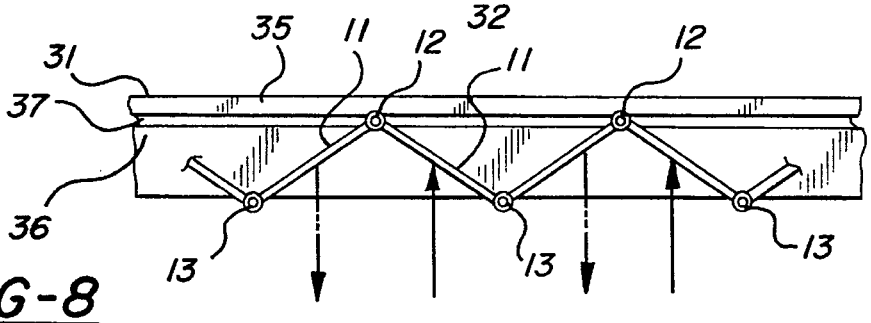
FIG-8

ACCORDION FOLD PANEL GUIDE TRACK

BACKGROUND OF INVENTION

This invention relates to an improved support and guide track for use with accordion fold panel closures and, particularly, a construction designed to retain the panel in place when the panel is subjected to very high pressures from high velocity, hurricane-force winds.

Conventional accordion fold panels, which are used as closures or doors, consist of a series of vertically arranged, narrow blades which are hingedly connected together along their vertical edges. The upper edges of the panel blades are suspended from an upper guide-support track by means of suitable support members, such as rollers riding in channels formed in the upper support track. The lower ends of the panel blades are commonly either free or, alternatively, may be provided with pins which fit within a lower guide track. If the support members and pins are located in vertical alignment with the hinged connections between the blades, which is one conventional type of panel construction, the alignment occurs at alternating hinge connections. Every other hinge connection located between the alternating, aligned connections, is located laterally, outwardly of the tracks. Thus, the other hinge connections, that are located between the aligned support member, hinge and pin connections, may move freely laterally away from the track when the panel is accordion folded and may move laterally towards the track when the panel is extended.

In the conventional accordion fold panel closures that are commonly used, there is relatively little resistance to high velocity winds applied against the panel surface when the panel is extended or opened across a building opening. Thus, in the case of gale force or hurricane force winds, a conventional accordion fold panel closure may be blown away by the positive force of the wind or, conversely, sucked away by a negative wind force applied to the panel surface.

There has been a recognized need, in recent times, for an accordion fold panel closure construction which is able to resist high wind forces, whether positive or negative, so as to remain in place to protect a building during gales or hurricanes or the like high wind conditions. This present invention addresses that problem and provides a construction which is capable of retaining an accordion fold panel in place when the panel is subjected to high pressure.

SUMMARY OF INVENTION

This invention relates to an improved accordion fold panel closure construction and, particularly, an improved support-guide track construction for such a panel which cooperates with the panel to withstand high velocity winds applied to the panel surfaces. The invention contemplates a conventional accordion fold panel which is formed of numerous, vertically arranged, narrow blades that are hinged together edge-to-edge. As is conventional, the upper ends of the hinge points of every other hinge of the panel are provided with a suspension or support member. The support members may be in the form of a pair of rollers riding within adjacent channels formed within a guide and support track that is secured to the fixed building structure above the panel. The low end points of every other hinge location are each provided with a downwardly depending guide pin. Each pin carries a widened washer which fits within an upwardly opening, channel shaped, lower guide track. The lower guide track is fastened to the fixed building structure beneath the panel and has an upwardly opening mouth within which the pins and washers fit. A pair of opposed flanges formed on the lower track channel, partially close the mouth of the channel and provide, between the flanges, a narrow, continuous, elongated slot extending along the track to receive the pins and washers.

One of the flanges is provided with a laterally opening edge groove which opens towards the opposite flange. The uppermost leg of the edge groove is horizontally aligned with the opposite flange. Thus, the washers fit within the edge groove and are overlapped by the opposite flange. Consequently, the suspended panel, when opened to extend across a building opening, has numerous pins and washers located within the lower channel, in the edge groove of one flange of the lower channel-shaped track and underneath the opposing flange of the track. This provides a construction which, unexpectedly, is capable of resisting very large forces that are applied to the panel by high winds and to hold the panel against blowing out or being sucked out of the building opening.

Further, it is contemplated to provide a single extruded track which, due to its physical construction, may be used either as an upper, support and guide track or, as a lower guide track.

An object of this invention is to provide a guide track extrusion which may function either as an upper support guide track or a lower support guide track, depending upon how it is mounted within a building opening, for an otherwise generally conventional accordion fold panel closure. The tracks include a means for retaining the lower end of the panel against removal from the lower guide track despite the panel being subjected to unusually heavy wind forces, such as gale or hurricane force winds.

Another object of this invention is to provide a mounting and retaining system for an accordion fold closure which, without any substantial increase in expense, provides the means for resisting very high wind loads which would otherwise blow out or suck out the closure, depending upon whether the wind force is positive or negative relative to the closure surface.

Yet another object of this invention is to provide what visually appears to be a traditional or conventional accordion fold panel closure system that may be mounted either within a building opening or upon the wall structure surrounding an opening, and yet possesses sufficient strength to withstand extraordinarily high wind loads.

These and other objects and advantages of this invention will become apparent upon reading the following description, of which the attached drawings form a part.

DESCRIPTION OF DRAWINGS

FIG. 1 is an elevational end view of a fragment of an accordion fold panel closure mounted within an upper support-guide track and a lower guide track, with the tracks secured within the upper and lower fixed structure of a building opening.

FIG. 2 is a perspective end view of the upper track.

FIG. 3 is a perspective, end view of the lower track.

FIG. 4 is an end view of a modified upper track having wall mounting flanges.

FIG. 5 is a perspective view of a lower track which is identical to the upper track of FIG. 4.

FIG. 6 is an end, elevational view of the lower end of a panel and shows the panel moved into a position caused by a positively applied pressure.

FIG. 7 is a view similar to FIG. 6 but shows the panel lower end arranged in a laterally moved position caused by a negatively applied wind force.

FIG. 8 is a schematic view of a fragmentary, plan view illustrating the application of positive or negative wind forces against the panel.

DETAILED DESCRIPTION

FIG. 1 illustrates a fragment of a conventional accordion fold panel closure 10. The panel is formed of numerous, vertically elongated, narrow blades 11. These blades are connected to each other along their vertical edges by a hinge construction. There are different, conventionally used hinge constructions and, therefore, the hinge construction is schematically illustrated since it forms no part of the invention. Thus, FIG. 1 illustrates an inner hinge construction having an inner hinge rod 12 extending vertically through adjacent hinge connection parts of a pair of adjacent blades. Similarly, a hinged outer connection is illustrated with a vertically elongated outer hinge pin 13 which extends through the hinge connection leaves of adjacent blades. The inner and outer hinge connections alternate along the width of the panel.

The particular panel structure is not material to the present invention. Thus, the panel is shown as being suspended, in a conventional manner, from support members which comprise upwardly extending pins 15 located in alignment with the inner hinge joints. The upper pins 15 may be secured by conventional plates 16 to the upper ends of the adjacent hinges or hinge rods 12. Each support member is provided with a transverse axle 17 fastened by a suitable bracket 18 to its upper pin 15. The axle carries a pair of spaced apart, rotatable wheels 19 which are intended to ride within channels, which will be described below, for supporting and guiding the panel as the panel is slid into its extended position or its folded position.

Every other hinge location is provided with a support member. The intermediate hinges are provided with an outer, upper guide pin 20 which may be fastened by a mounting plate 21 to the upper end of outer hinge rod 13 or to the upper end of the respective panel blades in alignment with the hinge rod 13.

The panel includes lower track guide pins 25 that are fastened by plates 26 to the lower edge of the panel at each inner hinge. These lower track guide pins are arranged in vertical alignment with the support members. Similarly, outer, downwardly extending guide pins 27, secured by plates 28 to the lower end of the outer hinge rod 13 or the adjacent hinge structure, are aligned with the upper guide pins 20. The foregoing construction is conventional.

Turning now to the tracks, FIGS. 2 and 3 illustrate identical, extruded tracks which are reversely arranged to form an upper track 30 and a lower track 31. These tracks are preferably formed of extruded metal and are generally in the shape of open channels. Each track has a base 32 and integral side walls 33 and 34. An outer flange 35 and an inner flange 36 are integrally formed on the free ends of the channel walls and extend towards each other to partially close the mouth of the channel. The flanges terminate at a distance from each other to provide a lateral, narrow slot or opening 37 which extends the length of the track.

The inner flange 36 is formed with a laterally opening, narrow groove 38 that extends its full length. The groove is provided with a base 39, an outer leg 40 and an inner leg 41 (see FIGS. 5 and 6). The outer leg 40 is horizontally aligned or generally co-planar with the outer flange 35.

Preferably, the inner flange 36 is extended sideways to provide an integral, narrow, guide flange 42 that extends along the length of the track. The guide flange 42 is provided with a bent down or bead-like rim or guide edge 43.

The interior of the channel-shaped track is provided with an opposed pair of interior wheel channels. These wheel channels are formed by an integral pair of inwardly extending ridges 45 (see FIGS. 6 and 7) formed on the base 32 of the track. In addition, V-shaped surfaces 46 are formed on the outer flange 35 and inner flange 36 to approximate the cross-sectional shape of a pair of conventional accordion fold panel support wheels. Thus, the ridges and the V-shaped surfaces form the opposed wheel channels 47.

FIG. 2 shows the track in its wheel-supporting arrangement, that is, with the channel of the track opening downwardly. Generally V-shaped in cross section wheels, which provide a balanced support system and which are conventional, are slid endwise into the opposing wheel channels 47. In order to avoid jamming of the wheels of the channels due to dust or dirt or liquids, the V-shaped surfaces 46 are provided with central gutter grooves 48 to facilitate the removal of any such debris or liquids.

The tracks shown in FIGS. 2 and 3 are designed to be fastened to the fixed support surfaces which define an opening in a building. V-shaped notches 51 (see FIGS. 6 and 7) are formed on the interior surface of the base 32 of the tracks in order to serve as guide points or locating points for screws. As shown in FIG. 1, the track is secured to the upper, fixed support surface which, for example, may comprise the overhead lintel 53 of a framed building opening. Screws 54 or similar mechanical fasteners serve to secure the track in place. The lower track, similarly, may be attached to the lower fixed support, such as a sill or the floor, 55, by means of screws As mentioned, the panel is assembled in place by sliding the support wheels endwise into the upper track so that the wheels are located within their respective channels. The lower track guide pins 25 are slid endwise into the lower track.

Each lower track guide pin 25 is provided with a widened washer or horizontally arranged roller 57 which may be fastened by a screw or the like 58 to the bottom of the track pin 25 (see FIG. 7). The washer is rigidly secured upon the depending track pin or, alternatively, it may be fastened rotatably so that it may rotate as it moves along the track with the flange groove 38.

In operation, when the upper and lower tracks are secured to their fixed supports in the building, with the accordion-fold panel in place, the panel may be folded by sliding it in one direction or unfolded, to extend it, by sliding it in the opposite direction. At that time, the washers 57 slide within the lateral groove 38 in the flange 36 and, simultaneously, the washers are overlapped by the outer flange 35 which is in contact with the washer. When the panel is folded into its open position, that is, with the blades are bunched together for clearing the building opening, the hinge portions which carry the lower guide pins 27 are spaced laterally away from the guide flange rim 43 located on the guide flange 42 (see FIG. 1). Conversely, when the panel is slid in a direction to cover the building opening, the guide pins 27 laterally move toward and into contact with the guide flange rim 43, as indicated in dotted lines in FIG. 1.

In the event that the panel is subjected to a heavy wind force, such as wind forces in the range of gale or hurricane velocities, the pressure of the wind, illustrated by the solid arrows in FIG. 8, causes the panel lower end and the washers 57 to move laterally, generally completely out of the groove 38 and further beneath the overlapping flanges 35, as illustrated in FIG. 6. This locks the lower edges of the panel blades to the lower track and prevents the panel from being blown through the building opening.

In the event of a negative or low pressure wind, which occurs in hurricanes and tornadoes, the wind forces, illustrated in dotted-line arrows in FIG. 8, are in the opposite or suction direction. Thus, as shown in FIG. 7, the panel is sucked laterally and the washers 57 move more deeply into the groove 38. If the force is sufficient, the washers may bottom out against the base 39 of the groove 38. During that time, the washers are still overlapped by and held in place by the outer flange 35. With this arrangement, the lower edges of the panel blades are held against being sucked inwardly by the inward force of the wind.

The direction of positive and negative pressures of the wind may be reversed, depending upon the nature of the building construction and the particular high velocity wind storm which may cause such positive or negative wind pressures. In either event, positive or negative wind pressures, it can be seen that the lower end of the panel is firmly retained against being blown or sucked or otherwise removed from the bottom support track.

It has been found that the construction described above can normally resist three times, or more, the wind forces that a conventional panel construction and mounting can resist. By way of example, a panel constructed in accordance with this invention has been tested to resist winds of up to 250 m.p.h. In other words, at ground level, it resists winds that, in the event of a hurricane or a tornado, would result as if located at a place 20 stories above the ground, for example, as in a high rise building. Comparatively, a conventional panel and mounting resists only approximately 50 m.p.h. wind forces. The particular degrees of forces resisted, as compared with the conventional construction, can vary, depending upon the nature of the materials and the size and shape of the panels and tracks, etc. Thus, the figures given above are for illustrative or comparative purposes to illustrate the marked difference between the present construction and the conventional arrangements.

In some building installations, it is necessary to install the accordion fold panel tracks on the outside of a wall surrounding an opening, instead of within the opening structure. The modifications of FIGS. 4 and 5 are designed to accommodate a wall mounting arrangement. Thus, FIGS. 4 and 5 illustrate a modified upper track 60 and a modified lower track 61 which are identical except that one track is inverted relative to the other. The tracks are of the same structure as described above in connection with the tracks shown in FIGS. 1–3. However, the modified tracks include a pair of vertically oriented wall mounting flanges 62 and 63. Each of these flanges, which are generally co-planar, are provided with shallow V-shaped notches 64 which serve to locate screws 65 for fastening the flanges to the wall structure above and below a window-type opening in a building. Otherwise, the operation is the same as mentioned above.

This invention may be further developed within the scope of the following claims. Accordingly, having fully described at least one operative embodiment of this invention, I now claim:

1. In an accordion fold panel formed of a series of vertically arranged panel blades, that are hingedly connected together along their adjacent vertical edges, and an upper, elongated track from which the upper edge of the panel is suspended by support members that are fastened to the panel blades and are slidably engaged within the upper track so that the support members and the suspended panel blades may be slid horizontally beneath the upper track for extending and folding the panel for respectively covering and uncovering an opening over which the panel is positioned, and a lower, elongated track formed of an upwardly opening channel into which downwardly extending pins, which are secured to the lower edges of pre-selected panel blades, extend for sliding within and along the length of said lower channel track for guiding the panel during the folding and extending of the panel over said opening, the improvement comprising:

said lower track being substantially identical to said upper track and formed of an extruded channel having a base, integral side walls, and an open channel mouth, with each of the walls having an integral flange on its free edge and with the flanges extending toward each other to partially close the mouth of the channel;

one of said flanges having a groove formed in its free edge, with the groove opening towards the opposite flange;

said downwardly extending pins each having a widened washer secured upon its end with the washer normally extending into said groove and, also, being overlapped by the other of said flanges;

said washer being slidable along the length of the lower track within the groove and in sliding contact with the overlapping flange when the pins are slid endwise within the lower track;

and said washers being movable transversely of the lower track in one direction to closely fit within, towards engagement with the base of, said groove, while still being overlapped by the other flange, and being movable transversely in the opposite direction to substantially leave the groove while still remaining overlapped by said other flange, so as to hold the lower edge of the panel in place relative to the lower track when the panel is subjected to the pressure of high wind forces, to thereby prevent the panel from being blown or pulled away from the opening by either positive or negative wind caused pressures.

2. A construction as defined in claim 1, and said groove having spaced apart outer and inner generally horizontally arranged walls and a generally vertical base, with the outer wall being substantially co-planar with said other flange, so that the washer is normally overlapped by said groove outer wall, as well as said other flange, but the washer may move, under corresponding lateral pressure applied to the panel, towards the groove base or in the opposite direction away from the groove base.

3. A construction as defined in claim 2, and the washer being movable under corresponding lateral pressure applied to the panel, completely out of the groove while still overlapped by said other flange.

4. A construction as defined in claim 2, and including a narrow, substantially uniform width guide flange formed integral with one side wall of the channel and extending substantially the full length of the channel, with the guide flange having a free, guide edge;

and with a downwardly extending pin arranged at each hinge connection of each adjacent pair of panel blades, and with the pins alternatively fitting within the lower track and located outside the track for engagement with said guide edge.

5. A construction as defined in claim 4, and said upper track being identical to said lower track, so that the same extrusions may be used as either upper or lower tracks, with the upper track being inverted so that it opens downwardly, and with the tracks having an internal channel formed on each of the opposing side walls of the channel, within the tracks, and with the internal channels opening laterally towards each other, and each internal channel being shaped in cross section to closely receive a support wheel;

said panel support members each having a pair of axially aligned support wheels fitted within the adjacent internal channels of the upper track, with the wheels secured to an upstanding member attached to a panel blade hinge member for slidably supporting an adjacent pair of hinged blades;

and with a support member being provided at every other blade hinge location.

6. A construction as defined in claim 2, and including upwardly and downwardly extending, narrow, vertical mounting flanges formed integral with one of the side walls of the tracks and extending the length of the track for arranging against a vertically arranged fixed support, such as a wall and the like, for mounting the track against a wall-like surface.

7. A construction as defined in claim 2, and said track being attached to a fixed support by means of screws extending through the base of the track into the fixed support.

8. A guide track in combination with an accordion fold panel having numerous, vertically arranged, narrow panel blades hingedly connected together edge-to-edge and having guide members on their opposite edges for slidably fitting within guide tracks, said guide track comprising:

an extruded channel having a base and integral side walls with integral flanges formed on the free ends of the side walls and extending towards each other to provide a continuous, narrow opening between the flanges, which opening extends the length of the track;

one of said flanges having a continuous groove formed in its edge, with the groove defined by an outer leg, an inner leg and a base, and with the groove opening laterally towards the second of said flanges;

the groove outer leg being substantially co-planar with the second flange; whereby a generally flat washer arranged upon a guide member may extend laterally of the track opening and fit within the groove and be overlapped by the second flange, said flanges being spaced with respect to one another and said groove having a desired depth such that said washer may be moved laterally, when heavy negative or positive pressure is applied to a panel to which the guide member is secured, either more deeply into the groove to the point of engaging the groove face or laterally outwardly completely out of the groove, with the guide member substantially abutting one of said flanges while still being overlapped by the second flange to prevent the washer and its guide member from being pulled out of the track.

9. A guide track as defined in claim 8, and including a narrow, substantially uniform width guide flange formed integral with one side wall of the channel and extending substantially the full length of the channel, with the guide flange having a free, guide edge;

whereby a downwardly extending pin arranged at a hinge connection of an adjacent pair of panel blades, located outside of the track, may engage and be guided by said guide edge.

10. A construction as defined in claim 8, and said track being usable either as an upper track or as a lower track, by inverting the track to open downwardly for upper track use, so that the same extrusion may be used either as an upper or lower track, and with the tracks having an internal channel formed on each of its opposing side walls within the interior of the track, so that the internal channels open laterally towards each other, with the internal channels being shaped in cross-section to closely receive support wheels attached to an accordion fold panel for supporting and guiding such support wheels.

11. A construction as defined in claim 10, and including gutter grooves formed in, and extending along the length of each of the side wall grooves for locating beneath wheels located within such grooves.

12. A construction as defined in claim 8, and including upwardly and downwardly extending, narrow, vertical mounting flanges formed integral with one of the side walls of the track and extending the length of the track for arranging against a vertically positioned fixed support, such as a wall and the like, for mounting the track thereon.

* * * * *